US005301704A

United States Patent [19]

Brown

[11] Patent Number: 5,301,704

[45] Date of Patent: Apr. 12, 1994

[54] WALKING CANE USABLE ON SLIPPERY AND ICY SURFACES

[76] Inventor: E. Evangeline Brown, R.R. #1, Box 2229, Shapleigh, Me. 04076

[21] Appl. No.: 33,536

[22] Filed: Mar. 18, 1993

[51] Int. Cl.[5] ..... A45B 9/04

[52] U.S. Cl. ..... 135/78; 135/84

[58] Field of Search ..... 135/65, 77, 78, 80, 135/81, 82, 84, 86

[56] References Cited

U.S. PATENT DOCUMENTS

| | | | |
|---|---|---|---|
| 2,116,941 | 5/1938 | Francis | 135/86 X |
| 3,177,884 | 4/1965 | Thro . | |
| 3,448,749 | 6/1969 | Stark | 135/81 X |
| 4,098,283 | 7/1978 | Tritle . | |
| 4,899,771 | 2/1990 | Wilkinson | 135/77 |
| 5,103,850 | 4/1992 | Davis | 135/84 |

FOREIGN PATENT DOCUMENTS

| | | | |
|---|---|---|---|
| 371075 | 1/1907 | France | 135/84 |
| 645650 | 2/1979 | U.S.S.R. | 135/84 |
| 675275 | 7/1952 | United Kingdom | 135/84 |

*Primary Examiner*—Carl D. Friedman
*Assistant Examiner*—Lan C. Mai
*Attorney, Agent, or Firm*—Frederick R. Cantor

[57] ABSTRACT

A walking cane has an enlarged foot piece, formed with a convex arcuate lower surface, that functions as a small rocker. One, or two, rows of spikes extend downwardly from the arcuate surface, for penetration and gripping of icy surfaces. An elastomeric, resilient pad may be attached to the arcuate lower surface of the foot piece, to adapt the cane for use on normal walking surfaces, such as carpets, hard floors, and outdoor sidewalks. The pad has a series of sockets that fit onto the spikes for retention of the pad on the foot piece. The arcuate surface contour on the foot piece is advantageous in that it enables the spikes or resilient pad to maintain a non-slip, rocking engagement with the walking surface during the entire walking stride, i.e., while the person is using the cane to partially support his or her own weight during forward motion of the person's body.

6 Claims, 1 Drawing Sheet

WALKING CANE USABLE ON SLIPPERY AND ICY SURFACES

BACKGROUND OF THE PRESENT INVENTION

The present invention relates to walking canes.

The present invention more particularly relates to walking canes adapted for use on icy and slippery surfaces, as well as on non-slippery surfaces.

One problem with conventional walking canes is that when a person extends the cane forwardly, in order to take a step, the cane is then slightly oblique to the walking surface. If the sidewalk, pavement, or other walking surface, is icy, the lower end of the cane may tend to slide forwardly along the walking surface, thereby causing the person to lose his or her balance.

Another problem concerns operation of the cane on soft terrain, such as loose gravel, sand, or soft earth. An ordinary cane has a rubber cup on its lower end, adapted to resiliently deform and grip the walking surface. When the walking surface is soft, or loose, the lower end of the cane tends to sink into the soft surface, so that the person has a tendency to topple sidewise when he, or she, puts any weight on the cane. The rubber cup on the lower end of the cane will not support the cane on soft terrain.

Various cane, or crutch, constructions have been devised to overcome the above-noted problems. U.S. Pat. No. 3,177,884, granted to W. C. Thro, on Apr. 13, 1965, discloses a crutch, having a rubber cup, that has an internally threaded insert in its lower wall. A removable spike structure can be threaded into the threaded insert, so that the tip of the spike extends axially downwardly, from the shaft portion of the crutch, or cane.

The cane construction of U.S. Pat. No. 3,177,884 would presumably have some utility on icy surfaces, in that the spike could possibly be made to penetrate and embed itself in the ice layer, thereby tending to prevent the cane tip area from sliding along the ice surface. However, it is doubtful that the cane would be usable on soft terrain, since the rubber cup would tend to sink into such terrain. The rubber cup has only a relatively small end area in contact with the terrain surface, so that the rubber cup will not prevent the cane from sinking into soft terrain.

U.S. Pat. No. 4,098,283, issued to R. Tritle, on Jul. 4, 1978, shows a rubber cup, attachable to the lower end of a crutch or cane. A circular disk is secured to the lower face of the cup. As shown in FIG. 3, of the patent, the lower face of the disk has a slight convex curvature. At its peripheral edge, the circular disk has an annular ridge. The patentee indicates that the annular ridge will cut in-to and grab a sand surface. Apparently a cane equipped with the cup-disk assembly can be used on sand, ice, or snow.

One potential problem with the circular disk construction of U.S. Pat. No. 4,098,283 is that when the person extends the cane forwardly to begin a step, the circular disk will initially engage the walking surface at a particular point on the annular ridge. If the walking surface is hard, the disk may tend to roll laterally, with the annular ridge acting as a small wheel. Such a rolling motion could cause the cane to slip out from underneath the person's hand.

U.S. Pat. No. 5,103,850, issued to R. C. Davis, on Apr. 14, 1992, shows a crutch construction, having a flared base at its lower end. The bottom surface of the base has a convex arcuate shape, so that the base can have a rocking motion on the walking surface. The flared base is provided with a resilient elastomeric boot that fits onto its arcuate bottom surface. The arcuate surface of the boot is resilient, so as to have a gripping action on the subjacent walking surface.

A deficiency of the cane, or crutch, of U.S. Pat. No. 5,103,850 is that it has minimal utility on icy surfaces. The curved elastomeric surface of the boot could not be expected to grip an icy surface. More likely, the curved rubber surface would tend to slide on icy surfaces.

SUMMARY OF THE PRESENT INVENTION

An object of the present invention is to provide a walking cane.

A further object of the present invention is, more particularly, to provide a walking cane adapted for use on icy and slippery surfaces, as well as on non-slippery surfaces.

The present invention is directed to a walking cane, having a foot piece, or base, whose lower surface is arcuate and convex, whereby the foot piece is enabled to have a rocking motion, as the person strides forward. At least one row of spikes extends downwardly from the lower surface of the foot piece. When the person is walking on an icy surface, the spikes, or prongs, penetrate and grip the icy surface. By providing a row of spikes, as opposed to a single spike, it is possible to maintain different ones of the spikes in contact with the icy surface, throughout the course of each rocking motion, thereby minimizing the possibility of slippage at any point in the person's stride.

A resilient elastomeric pad is removably attached to the lower surface of the foot piece for normal usage of the cane on hard surfaces or loose terrain, where the spikes would be ineffective. The resilient pad has sockets in its upper surface that fit onto the spikes on the lower surface of the foot piece, such that the pad is retained on the foot piece without any additional attachment mechanism, other than the spikes themselves.

BRIEF DESCRIPTION OF THE DRAWINGS OF THE PRESENT INVENTION

DESCRIPTION OF THE PREFERRED EMBODIMENTS OF THE PRESENT INVENTION

Figure 1:
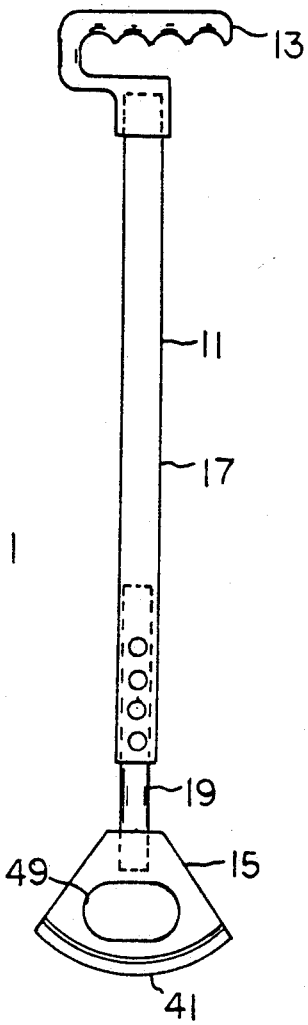
FIG. 1, is a side elevational view of a walking cane, constructed according to the present invention.

FIG. 1, is a side elevational view, of a walking cane, constructed according to the present invention.

FIG. 1, shows a walking cane that comprises an elongated shaft 11, a handle 13, at the upper end of the shaft 11, and a foot piece 15, at the lower end of the shaft 11. Handle 13, is preferably configured so that when the person's hand is gripping the handle 13, the hand will be directly over the shaft 11, rather than offset from the shaft. With this arrangement, the hand pressure is concentrated, or centered, on the shaft axis, such that the cane is less likely to slip on the walking surface.

Shaft 11, is shown as an adjustable two-piece shaft, that can be adjusted to have different overall lengths, related to the physical size, and needs of the person using the cane. The shaft 11, comprises an elongated tube 17, preferably formed of light-weight aluminum, and a relatively short lower shaft element 19, formed preferably of wood, metal, or plastic. Shaft element 19, is telescopically connected to tube 17, so that it can be moved axially for adjusting the overall length of the two-piece shaft 11.

Figure 2:
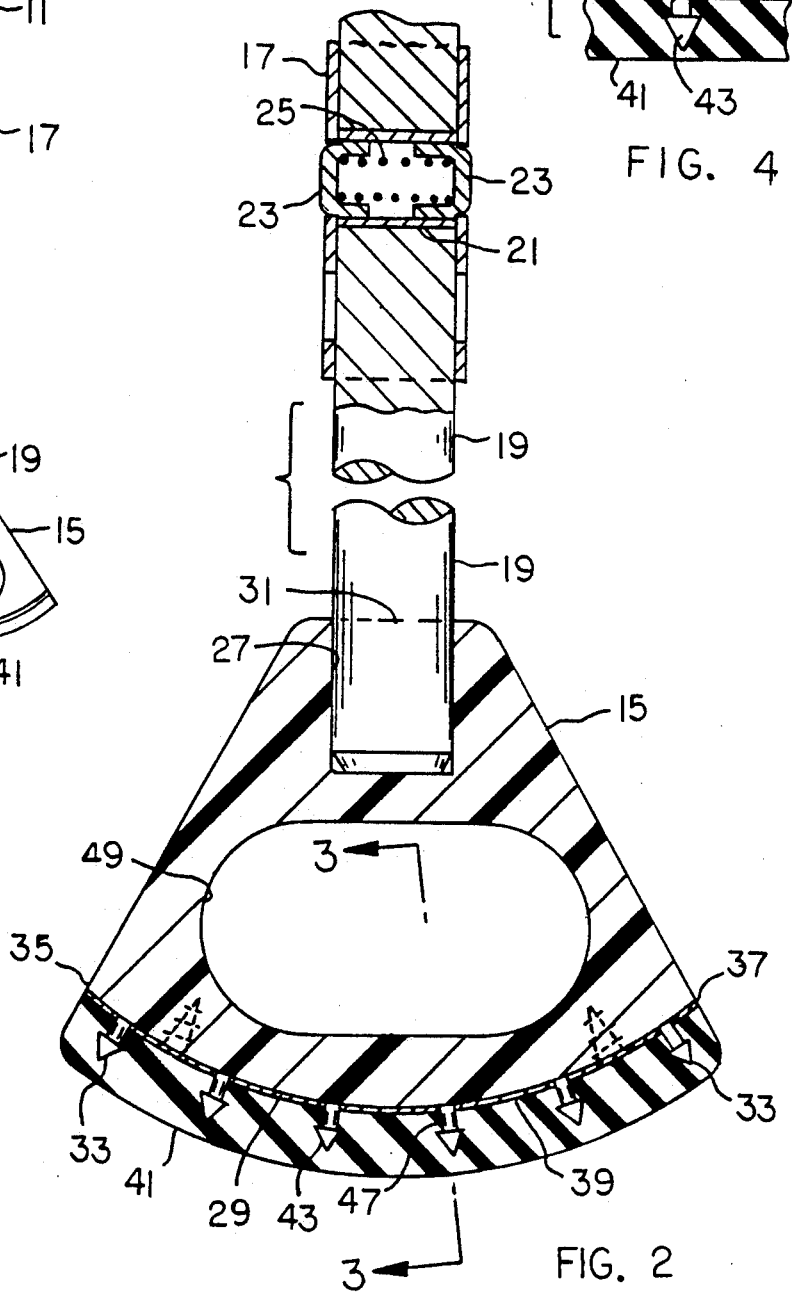
FIG. 2, is an enlarged fragmentary sectional view, of the FIG. 1 walking cane, showing structural features that are not apparent from FIG. 1.

FIG. 2, is an enlarged fragmentary sectional view, of the FIG. 1 walking cane, showing structural features that are not apparent from FIG. 1.

Tubular shaft element 17, has two rows of aligned holes, extending therealong, near its lower end. As shown in FIG. 2, shaft element 19, has a transverse tubular guide 21, that slidably supports two bullet-shaped detents 23. A compression spring 25, extends within and between the detents 23, to normally urge them apart to the positions depicted in FIG. 2. When it is desired to adjust the overall length of shaft 11, the two detents 23, are manually squeezed together, such that shaft element 19, can be moved axially to a new adjusted position on the tubular shaft element 17. When the detent elements are aligned with a new set of aligned openings, they automatically snap into the openings, under the impetus of coil spring 25.

Foot piece 15, comprises a solid block formed preferably of wood, metal, or plastic. The block has a socket 27, that fits snugly on the lower end of shaft element 19. An adhesive can be used on the shaft element surface, to affix the foot piece 15, to the shaft 11.

Figure 3:
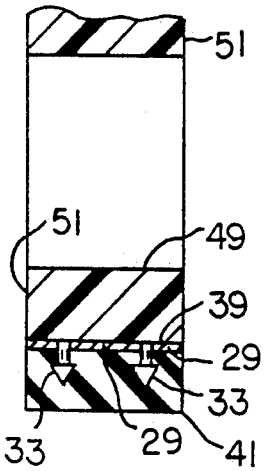
FIG. 3, is a fragmentary sectional view, taken essentially along line 3—3, shown in FIG. 2.

FIG. 3, is a fragmentary sectional view, taken essentially along line 3—3, shown in FIG. 2.

The lower surface of foot piece 15, comprises a convex arcuate surface 29, centered on a transverse axis 31, passing through the shaft 11, near its lower end. In the transverse plane, coincident with axis 31, surface 29, is flat, as seen, for example, in FIG. 3. Two rows of pointed spikes 33, project downwardly from arcuate surface 29. FIG. 3, shows one spike 33, in each of the two rows. FIG. 2, shows the spikes 33, in one of the rows. As illustratively shown in the drawing, there are twelve spikes 33, i.e., six spikes 33, in each of the two rows.

Spikes 33, extend along essentially the entire lower surface of foot piece 15, so that there are two spikes 33, in near proximity to the leading edge 35, of the foot piece 15, and two spikes 33, in near proximity to the trailing edge 37, of the foot piece 15. During usage of the cane on an icy walking surface, foot piece 15, will rock around transverse axis 31. Successive ones of spikes 33, will penetrate and grip the icy surface, to prevent the walking cane from slipping, and possibly causing, the person to lose his, or her, balance. By providing a relatively large number of spikes 33, spanning the entire length of the arcuate surface 29, there is an added assurance against slippage of the cane at any one point during the walking stride. During the course of a given rocking motion of the foot piece 15, there will, at any point in time, be at least two spikes 33, in contact with the icy surface.

Spikes 33, can be rigidly attached to the lower surface 29, of the foot piece 15, in various ways. As shown in FIGS. 2 and 3, the spikes 33, are welded to a metal band 39. The band 39, is later attached to arcuate surface 29, by screws, and/or adhesive.

Figure 4:
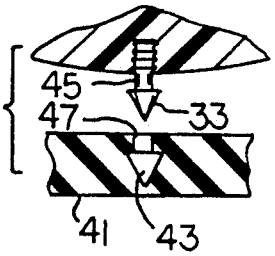
FIG. 4, is a fragmentary sectional view, through an alternate spike construction, that can be used in the walking cane of FIGS. 1 through 3.

FIG. 4, is a fragmentary sectional view, through an alternate spike construction, that can be used in the walking cane of FIGS. 1 through 3.

As shown fragmentarily in FIG. 4, the spikes 33, can be attached individually to the foot piece 15, e.g., by drilling holes in the foot piece 15 arcuate surface 29, and forming the individual spikes 33, with mating threaded, or grooved, shank portions. The shank portions of the spikes 33, are press fit into the drilled holes to achieve interference fits with the hole surfaces. Depending on the nature of the fit, the spikes 33, will be removable, or permanently affixed to the foot piece 15. Each spike 33, is preferably formed of steel or wear resistant metal alloy.

Spikes 33, are not effective, or practical, on normal walking surfaces, such as wooden floors, carpets, concrete, or asphalt, etc. However, an elastomeric resilient pad 41, can be removably attached to the lower surface of foot piece 15, when it is desired to use the walking cane on such surfaces. Pad 41, is co-extensive with arcuate surface 29, such that the pad 41, entirely covers surface 29.

Pad 41, is formed with a series of sockets 43, in its upper surface, said sockets 43, being spaced the same distance apart as the spikes 33. Each spike 33, has an annular groove 45, in its side surface. The mating socket 43, has an annular lip 47, adapted to extend into the groove 45, whereby the resilient pad 41, is releasably retained on the lower surface of foot piece 15. The resilient pad 41, can be removed from the foot piece 15, when it is desired to use the cane on icy surfaces, or possibly on moderately soft ground, which the spikes 33, can penetrate and grip, without breaking loose. The primary usage of spikes 33, is on icy surfaces.

Pad 41, can be a flat rectangular pad in its detached state. During the process of placing the pad 41, against the arcuate surface 29, of foot piece 15, the pad 41, will conform to the arcuate surface configuration of the foot piece 15. Spikes 33, will retain the pad 41, in position on the foot piece 15, lower surface. The large number of spikes 33, offers good assurance of satisfactory retention of the pad 41, on the foot piece 15.

When pad 41, is not attached to the lower arcuate surface of the foot piece 15, it can be stored in a cavity 49, that extends transversely through foot piece 15, i.e., between the two side surfaces 51, of the foot piece 15, extending normal to arcuate surface 29, as viewed in FIG. 3. Since pad 41, is elastomeric and flexible, it can be curved into a circular loop configuration and placed into cavity 49, for storage. The natural resilience of the pad 41, material will bias the pad 41, to a frictionally-retained position, seated within the cavity 49. The purpose for storing the resilient pad 41, in the cane, as opposed to some other location, is to ensure that it will not be lost, or mislaid. The pad 41, will be readily available when it becomes necessary to install the pad 41, on the lower arcuate surface of foot piece 15.

In assembling the cane components together, it is necessary that handle 13, and foot piece 15, be in a common vertical plane, so that when the person manually thrusts the cane forwardly, the leading edge 35, of the foot piece 15, will constitute the forward edge of the foot piece 17. During forward motion of the person's body, partially supported by the cane, the foot piece 15, will have a slight rocking motion around transverse axis 31. The spikes 33, or resilient pad 41, will grip the walking surface to maintain the cane against slippage.

The present invention describes a walking cane, usable for walking on icy surfaces. Features of the present invention are recited in the appended claims. The drawings herein necessarily depict specific structural features and embodiments of the walking cane, useful in the practice of the present invention.

However, it will be appreciated by those skilled in the arts pertaining thereto, that the present invention can be practiced in various alternate forms and configurations. Further, the previously detailed descriptions of the preferred embodiments of the present invention, are presented for purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What is claimed is:

1. A walking cane comprising:

a shaft having an upper end and a lower end;

a handle on the shaft upper end;

a foot piece attached to the shaft lower end;

an axis of curvature extending transverse to the length dimension of said shaft, near the shaft lower end;

said foot piece having a convex arcuate lower surface centered on said axis of curvature;

said arcuate lower surface being essentially flat in a direction parallel to said axis of curvature, whereby the foot piece is enabled to have a rocking motion around the axis of curvature when the cane is used for walking purposes;

at least one row of pointed spikes projecting downwardly from the arcuate lower surface of the foot piece for tractive gripment in ice;

a resilient pad removably attached to the lower surface of said foot piece, said resilient pad having an upper surface and a lower surface;

the pad upper surface having a series of sockets therein spaced the same distance as the spikes, whereby the pad can be positioned on the lower surface of the foot piece, with the spikes fitting within the sockets;

each spike having a side surface, and an annular groove in said side surface; and each socket comprising an annular lip extending into the annular groove in the side surface of the associated spike, whereby the spikes retain the pad on the foot piece.

2. The walking cane, as described in claim 1, wherein there are two rows of spikes on the lower surface of the foot piece.

3. The walking cane, as described in claim 1, wherein the foot piece has a leading edge and a trailing edge;

said spikes comprising two rows of spikes extending between the leading edge and the trailing edge of the foot piece; and said rows of spikes covering essentially the entire lower surface of the foot piece, so that there are two spikes in near proximity to the leading edge of the foot piece, and two spikes in near proximity to the trailing edge of the foot piece.

4. A walking cane comprising:

a shaft having an upper end and a lower end;

a handle on the shaft upper end;

a foot piece attached to the shaft lower end;

an axis of curvature extending transverse to the length dimension of said shaft near the shaft lower end;

said foot piece having a convex arcuate lower surface centered on said axis of curvature;

said arcuate lower surface being essentially flat in a direction parallel to said axis fo curvature, whereby the foot piece is enabled to have a rocking motion around the axis of curvature when the cane is used for walking purposes;

at least one row of pointed spikes projecting downwardly from the arcuate lower surface of the foot piece for tractive gripment in ice;

a resilient pad removably attached to the lower surface of said foot piece, said resilient pad having an upper surface and a lower surface;

the pad upper surface having a series of sockets therein spaced the same distance as the spikes, whereby the pad can be positioned on the lower surface of the foot piece, with the spikes fitting within the sockets; and means on the said foot piece for storing the resilient pad when said pad is detached from the foot piece.

5. The walking cane as described in claim 4, wherein said storing means comprises a cavity extending through the foot piece parallel to said axis of curvature.

6. The walking cane as described in claim 4, wherein said foot piece has two parallel side faces; and said storing means comprises a cavity extending through said foot piece between said parallel side faces.

* * * * *